US008517632B2

(12) United States Patent
Later

(10) Patent No.: US 8,517,632 B2
(45) Date of Patent: Aug. 27, 2013

(54) SYSTEMS AND METHODS FOR COLLECTING CRUDE OIL FROM LEAKING UNDERWATER OIL WELLS

(76) Inventor: Roger Carson Later, Santa Monica, CA (US)

( * ) Notice: Subject to any disclaimer, the term of this patent is extended or adjusted under 35 U.S.C. 154(b) by 23 days.

(21) Appl. No.: 13/115,774

(22) Filed: May 25, 2011

(65) Prior Publication Data

US 2011/0293372 A1 Dec. 1, 2011

Related U.S. Application Data

(60) Provisional application No. 61/348,177, filed on May 25, 2010.

(51) Int. Cl.
*E02B 15/04* (2006.01)

(52) U.S. Cl.
USPC ..... 405/60; 405/63; 405/210

(58) Field of Classification Search
USPC ..... 405/60, 63, 64, 65, 66, 67, 68, 210
See application file for complete search history.

(56) References Cited

U.S. PATENT DOCUMENTS 3,548,605 A * 12/1970 Armistead et al. ..... 405/60
3,681,923 A * 8/1972 Hyde ..... 405/60
3,745,773 A * 7/1973 Cunningham ..... 405/60
3,762,548 A * 10/1973 McCabe ..... 405/60
4,047,390 A * 9/1977 Boyce, II ..... 405/60
4,146,482 A * 3/1979 Shyu ..... 405/60
4,290,714 A * 9/1981 Strange ..... 405/60
4,324,505 A * 4/1982 Hammett ..... 405/60
4,358,218 A * 11/1982 Graham ..... 405/60
4,358,219 A * 11/1982 Burns ..... 405/60
4,395,157 A * 7/1983 Cunningham ..... 405/60
4,447,247 A * 5/1984 Naess ..... 405/60
4,449,850 A * 5/1984 Cessou et al. ..... 405/60
4,531,860 A * 7/1985 Barnett ..... 405/60
4,619,762 A * 10/1986 Delacour et al. ..... 405/60
5,213,444 A * 5/1993 Henning ..... 405/60
6,675,734 B2 1/2004 Eagles et al.
8,173,012 B1 * 5/2012 Che ..... 405/60
2002/0161272 A1 10/2002 Michel, Jr.
2002/0185438 A1 12/2002 Johnstone
2009/0194472 A1 8/2009 Jack et al.
2010/0003081 A1 1/2010 Doolaege
2011/0299929 A1 * 12/2011 Sabourin ..... 405/60
2011/0318106 A1 * 12/2011 Gateff et al. ..... 405/60
2012/0051840 A1 * 3/2012 Hatton ..... 405/60
2012/0070231 A1 * 3/2012 Al-Sharif ..... 405/60
2012/0087729 A1 * 4/2012 Oesterberg et al. ..... 405/60
2012/0155964 A1 * 6/2012 Carter et al. ..... 405/60

* cited by examiner

*Primary Examiner* — Frederick L Lagman
(74) *Attorney, Agent, or Firm* — SoCal IP Law Group LLP; Michael D. Harris

(57) ABSTRACT

A large diameter duct formed of flexible material extends above an undersea oil leak. The large diameter dissipates the high well head pressure, which, in turn, decreases the velocity of the escaping oil. Because the oil is contained within the tubular structure and is under low pressure, it will rise slowly due to differences in the oil's and seawater's specific gravities. At the top of the tubular structure, the oil and water flows into a reservoir where the oil floating above the water can be offloaded to a storage vessel.

17 Claims, 2 Drawing Sheets

FIG. 2
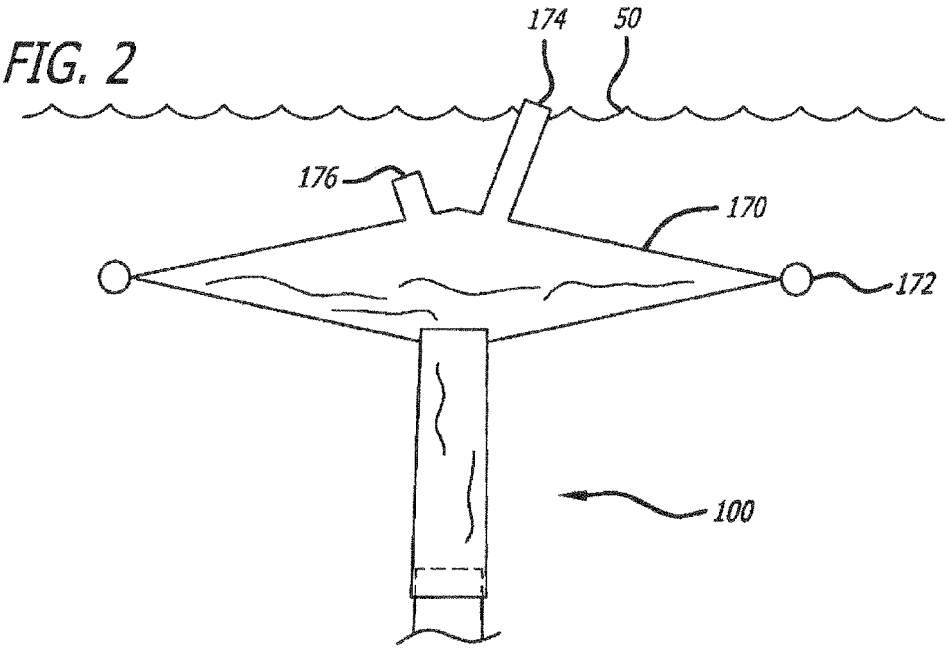
FIG. 3
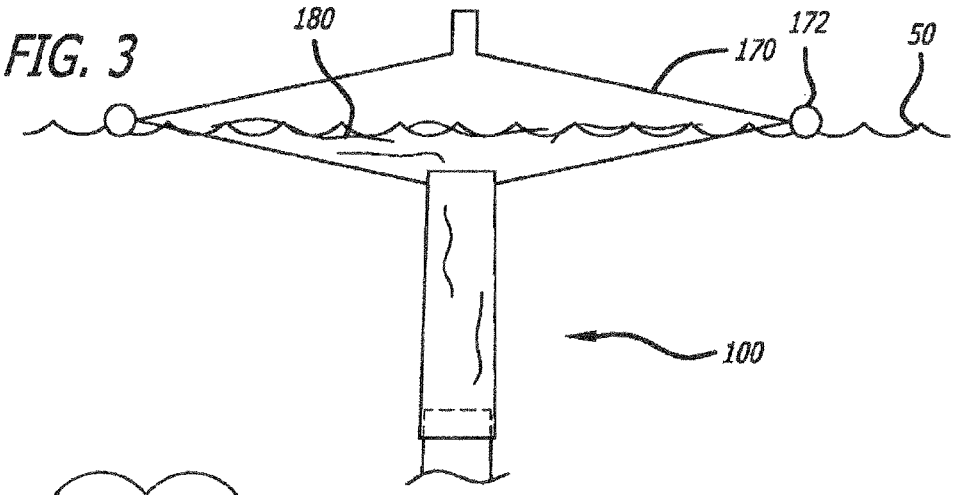
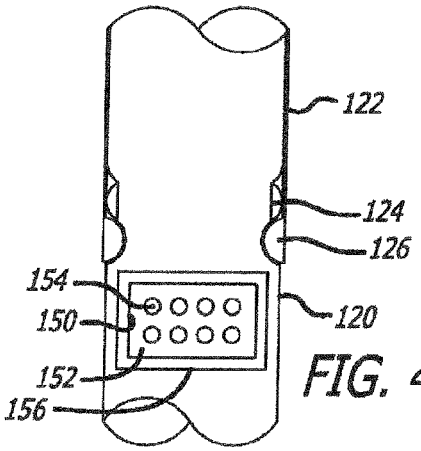
FIG. 4

SYSTEMS AND METHODS FOR COLLECTING CRUDE OIL FROM LEAKING UNDERWATER OIL WELLS

RELATED APPLICATION

Applicant claims priority based upon U.S. Provisional Patent Application No. 61/348,177, filed 25 May 2010.

BACKGROUND

1. Field

Collection of crude oil leaking from undersea oil wells.

2. General Background and State of the Art

In April 2010, an explosion on the Deepwater Horizon offshore drilling unit in the Gulf of Mexico lead to a massive oil spill. The well was about 5,000 feet (1,500 m) deep. By the time the underwater well was capped, about 4.9 million barrels of crude oil were released. From the initial leak to capping, about 53,000 barrels per day escaped.

Existing technology had great difficulty stopping the leak, probably for three reasons. First, leaks at almost a mile are difficult to reach and to act upon even if the capping process will work. Second, the oil is at very high pressure making any capping effort difficult. Third, damage to the wellhead structure left little with which to work.

At first, those working to stop the spill tried to use the existing blowout preventer. When that failed, most attempts to cap the well used mud or cement under high pressure to push against the high pressure of the escaping oil. After many tries using different approaches, the well was capped but not before millions of gallons of oil escaped during the long delays.

The Deepwater Horizon explosion and spill was not the first accident during undersea oil drilling. It likely will not be the last. Exploring, developing, and producing oil from undersea wells periodically results in an accidental leak leading to the unwanted loss of crude oil from the well facility. These ruptures cause the loss of crude oil leaking into the ocean and damage to marine and wetland environments.

A number of methods seek to stop the oil leak at its source. They include: (a) filling the sub-surface drilling pipe with drilling mud/cement to close the leaking pipe, (b) using explosives to close the leaking pipe and (c) drilling a "relief" well to relieve the leaking well pressure and direct the leaking crude oil to a new wellhead. Steel containers have been placed over the leak to attempt to connect a steel pipe to control the leak. However, as was evidence in the Deepwater Horizon incident, these methods were unable to respond promptly enough to prevent resulting environmental damage especially a mile below sea level.

The cost and complexity of mechanical recovery systems and the difficulty of deploying and installing such systems results in needless loss of crude oil and devastating damage to the marine and coastal environments. These mechanical systems attempt to cap and control the pressure of the leaking crude oil. This capping operation is extremely difficult in the deep/remote undersea environment. The operation not only requires the capping mechanism (mechanical capping block) but supporting equipment including hydraulic accumulators and manifolds necessary to control the pressure of the leaking crude oil.

Understandably, with more than 50,000 barrels of oil leaking every day and the oil slick growing in size, the well's owner were more concerned with stopping the leak than with containing the oil after it leaks from the well. Moreover, except for deploying booms to protect sections of the coast or around identifiable but relatively small slicks, little technology was available to collect most of the oil after it had leaked. However, a system that could contain already leaked oil would give those stopping the leak more time to act. In addition, as the oil flows out of the leak, the pressure may drop over time so that less oil continues to leak. The lower pressure may make stopping the leak easier. Therefore, if the leaking oil could be collected, stopping the leak over time may be made easier.

BRIEF DRAWING DESCRIPTIONS

FIG. 2 is a cross-sectional view showing the top of the system in which recovered oil is contained below the ocean's surface.

FIG. 3 is a cross-sectional view showing the top of the system in which recovered oil is contained one the ocean's surface.

FIG. 4 is a detailed side view of part if the system.

Figure 1:
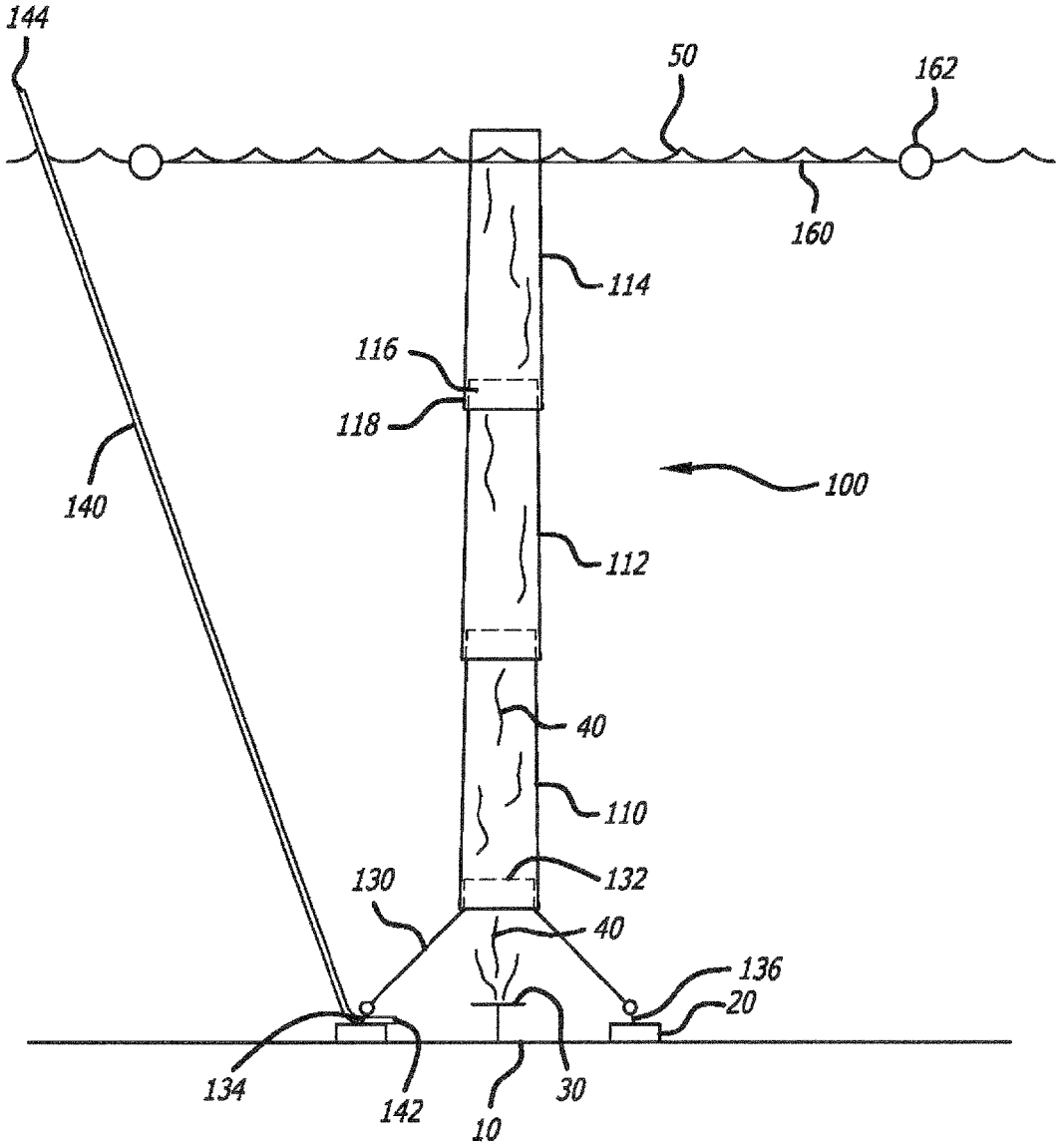
FIG. 1 is a cross-sectional view showing the system attached to the ocean bed and extending to the ocean's surface.

The figures are not to scale.

SUMMARY

Instead of relying on high pressure to cap the well, the system initially allows the oil to rise from the leak at the seabed to the ocean surface in a relatively large diameter flexible duct. The large diameter dissipates the high wellhead pressure, which, in turn, decreases the velocity of the escaping oil. Because the oil is contained within the tubular structure and is under low pressure, it will rise slowly. At the top of the tubular structure, the oil can be offloaded to a storage vessel. Alternatively, the oil could flow into a pool in the ocean surface surrounded by booms to keep the oil in the pool. The surface oil can be skimmed from the pool into a storage vessel.

Thus, the system dissipates the pressure of the leaking wellhead. At the same time, it directs leaking oil to a contained location where it can be recovered.

The system for collecting leaking underwater crude oil comprising one or more flexible plastic or rubber coated fabric ducts of large diameter or other internal dimension. The duct's large diameter dissipates the oil pressure so that the oil can be contained in ducts formed from materials that do not have to be strong enough to contain oil under pressure.

Because the oil is of a lower density that seawater, the oil rises in the duct to the ocean surface where it can be effectively collected. The duct is positioned close enough to the leak at the sea floor to capture leaking oil and prevent the oil from flowing outward into the ocean. Oil reaching the surface through the duct can be pumped into a vessel. Leaked fuel can be stored in flexible storage bladders or basins floating on the surface or subsurface of the ocean until a more suitable storage facility is available.

FIG. 1 shows wellhead 30 on sea floor 10. Oil 40 is leaking from the wellhead. In most leaks, the oil is at a very high temperature. Depending on ocean temperature—average water temperatures in the North Sea and the Gulf of Mexico are very different—currents and surface and other conditions, the oil dissipates as it rises. It rises because its specific gravity is less than that of seawater: 0.88-0.97 for crude oil versus 1.03 for seawater. Thus, when the oil reaches the surface, the resultant oil slick can cover many hundreds of square miles.

The system uses a duct 100 to contain the oil as it rises to the surface. Depending on the depth of the leak, a long duct of a single section can be used, but multiple sections probably are more practical for manufacturing, use, deployment and storage. FIG. 1 show duct 100 being divided into three sections, bottom section 110, middle section 112 and top section 114. The three sections are examples only. If each duct section is 50 feet long and the well is at 5,000 feet, the duct would require at least 100 sections. More than 100 sections are needed because the duct does not stand vertical, and some length is lost at the connections of adjacent duct sections.

The duct conducts the oil upward toward the sea surface. This ducting system may be constructed of a fabric such as nylon in any number of different weights and coated with a synthetic urethane or polyurethane coating. The coating may also be other plastic compounds such as chlorosulfonated polyethylene (CSPE), a polyvinylchloride (PVC), high-density polyethylene (HDPE), or a synthetic rubber compound such as, ethylene propylene deine monomer (EPDM). Other materials also may be acceptable. The ducts also could be formed from a combination of materials with a special coating on the inside or outside.

The duct sections may be made to be buoyancy neutral or can have either positive or negative buoyancy depending on what is desired. If positive buoyancy is desired or that the buoyancy of the rising oil and gases create too much buoyancy, one or more duct sections can be anchored to the ocean bottom. In addition, flotation devices such as gas-filled bladders or an inflatable rim may attach to one or more duct sections to hold the duct generally upright. Those flotation devices also could be position properly on each duct section, for example, near the top, to hold each duct section upward. Buoyancy factors can be varied to account for different conditions such as depth, position of the duct section, water and oil temperature, different materials used in different duct sections and other factors.

Each duct section can be frustoconical in that the diameter of the top of each section can be different from the section's bottom diameter. FIG. 1 shows the sections to be frustoconical in that top 116 of center section 112 may fit inside bottom 118 of section 114. Similarly, although not shown in the drawing, bottom 118 of top section 114 may fit inside top 116 of section middle section 112. Instead of tapering, frustoconical sections, the sections could be cylindrical with larger or smaller diameter portions at one end to mate with the adjacent end. Because the material of the ducts is flexible, fitting the end of one section into the end of the adjacent section may be possible even without a difference in diameter of the ends.

The duct sections may be cylindrical (circular) or other round shape. They also could be polygonal. Insofar as the application uses the term "diameter," it is not meant to be limited to the dimension of a circle or circular cylinder but to the large dimension across the inside of the duct.

The duct sections may be of equal or varying length. Ducts sections can be attached to each other by snaps, hook and loop fasteners, clips, rope, straps, wire, chain or the like to achieve the desired length for the overall duct.

FIG. 4 shows another arrangement. There, an upper section 122 includes an inward facing inflatable bladder 126. Likewise, lower section 120 has an outward facing bladder 124. The bladders can extend around the entire periphery of their respective duct, or they can be divided and spaced along the periphery. The bladders may be fillable with air, gas or buoyant liquid. The chosen fluid affects the buoyancy of the ducts. In fact, for adjusting the buoyancy of the entire duct, different fluids can be chosen for each bladder on a particular section, or different fluids might be used near the bottom, toward the middle and near the top of the duct.

With the bladders uninflated, the top of lower section 120 is inserted into the bottom of upper section 122. Inflating the bladders tends to lock the adjacent duct sections together. In FIG. 4, the bladders are curved and adjacent each other. Their shape may vary to improve the connections. Further, the bladders may be directly across from each other. The outside of the bladder of one duct section may have a surface that interacts with the surface of the bladder of the adjacent duct section such that the bladders lock together.

Depending on the size of wellhead 30 and the diameter near the bottom of lower duct section 110, the lower duct section may fit over the wellhead. Alternatively, hood or cover 130 is placed over the leaking wellhead or other structure of the well. The top 132 of the hood connects to the bottom of the lower duct section. The hood may be formed of the same material forming the duct sections or it could be another appropriate material in view of its size.

Cables (only cables 134 and are visible in FIG. 1) or other anchors connect hood 130 to the sea floor or other structure of the well. Permanent attachments 20 can be provided at the time of well construction for attaching the hood in case of a blowout or other leak. Robotic submersible can attach the hood to the sea floor or well structure. In shallower waters, human scuba divers may be able to secure the hood. Duct 100 may be deployed with the hood. Otherwise, the duct is attached to the hood after the hood is secured to the well or sea floor.

Hood 130 fills naturally with high-pressure seawater. The system is not designed to segregate the seawater from the oil. The water pressure at a depth of 5,000 feet is about 2,200 lbs./in$^2$ depending on water temperature and salinity. The pressure of oil leaking from the wellhead is in the 30,000 lbs./in$^2$ range. Though such high-pressure seawater may have some effect of slowing the flow of oil, the oil is under a higher pressure. It also contains gas. Thus, the oil and gas flows into the hood.

Because of the large diameter of hood 130, the oil dissipates and the pressure drops quickly. However, oil is not as dense as seawater. Therefore, it is more buoyant and rises. Following the hood's inside surface, oil flows toward the center of the hood where the hood connects to lower duct section 110. The oil flows into the duct where it continues moving up. The oil also is warmer than the seawater near the wellhead. Therefore, the oil will warm the water nearby, so that the oil and the water will move upward in the ducts. As the oil and water remain in contact, they may reach the same temperature. If so, only the buoyancy difference between water and oil caused by the specific gravity difference raises the oil in the duct.

The drawings are not to scale especially the distance from the wellhead to sea level and the diameter of the duct. The duct's diameter or other appropriate inside measurement is large, large enough to prevent the oil inside the duct to exert high pressures against the walls of the duct relative to the outside water pressure. It is estimated that ducts of between 4 ft. and 30 ft. should be able to dissipate the oil pressure and allow the oil to flow without significant obstruction. However, a 30 ft. diameter duct lying flat on a ship would be about 47 ft. wide. That may be unwieldy, although the duct could be folded longitudinally to make it narrower.

In addition, the material forming the duct sections could be stored as segments of individual, generally flat lengths of material. The duct sections could be formed by attaching the edges of the separate segments together. One advantage of such an arrangement is that it allows the duct sections' diameters to vary for different conditions by using more or fewer segments.

The cross-sectional area of a 30 ft. diameter duct is about 7,100 $ft^2$. As single 30 ft. diameter duct could be replaced with an equivalent number of smaller-diameter ducts to yield a similar cross-sectional area of a 30 ft. diameter duct. The multiple ducts may maintain an equivalent oil flow. However, the small-diameter ducts should not have such a small diameter that the oil pressure does not dissipate.

As an alternative, the ducts near wellhead 30 could have a large diameter, and at some depth, the duct could branch into smaller-diameter ducts.

Because of the rapid dissipation of the oil pressure, the internal and external pressures on the duct should be about the same although one could be somewhat higher. Normally, the outside pressure should not exceed the inside pressure to maintain the duct open. If the duct's collapsing becomes an issue, the duct sections could be provided with stays or other structure to keep the duct open. Bladders such as bladders 124 and 126 (FIG. 4) also can keep the duct open. For ease of storing the ducts, the stays or other structure keeping the ducts open may be removable and may be attached to the duct only at the time of deployment.

As the oil rises through duct 100, its temperature decreases. The water temperature generally increases from the sea floor to the ocean surface. However, the oil temperature drops quickly from its higher temperature when it escapes from the leak because of heat transfer to the colder seawater. The oil may approach the pour point for some components. The pour point of oil is the lowest temperature at which it pours or flow under prescribed conditions. Here, it means that when oil falls below its pour point, it cease flowing easily as a liquid. The pour point for crude oil varies between about 125° F. to −75° F. Though the oil may continue moving upward in the duct after its temperature falls below the pour point, its flow may become impeded as larger globs form. If the larger glob extends across the entire duct, the oil may act as a stopper to prevent water from flowing with the oil through the duct. If so, the rising oil must push the entire water column upward. The force from the different specific gravities of oil and water may be unable to drive the water column upward.

One could heat the oil. Thus, hot seawater or other hot liquid or gas could be injected in the ducts. Thus, injection tube 140 (FIG. 1) can transfer hot fluid from inlet 144 above or near the ocean surface 50 to through outlet 142 inside hood 130. Instead of or in addition to injecting hot water into the hood, water can be injected at appropriate locations along duct 100. Instead of water, the system could inject low toxicity petroleum distillates of a grade that would reduce the viscosity of the crude oil. Likewise, oil dispersant, such as soap, may serve the same purpose. If a gas is desired as a means to insure the flow of leaked crude oil to the surface for collection, oxygen, carbon dioxide, helium, or nitrogen or any other inert or active gases alone or in combination could be used for this purpose.

Some duct sections also may have relief outlets to allow water above the solidified oil stopper to escape from the duct. Thus, duct section 120 (FIG. 4) includes a gap 150 which holds a perforated screen 152. The perforations 154 are of a size that inhibits the flow of oil while permitting water in the duct to flow through the perforations. A screen or mesh may replace the perforations.

To prevent oil from flowing through the perforations, a backing 156 spaced from screen 152 may be provided. The backing intersects the inside of the duct at its bottom so that solidified oil moving upward does not go inside the backing. However, by having the top of the backing spaced from the duct, water, which is less viscous than oil, can flow inside the backing and out the perforations.

A canopy (not shown) may be provided over the perforations to direct water flowing through them.

The perforated screens may be provided at appropriate locations along duct 100 starting at the depth that oil approaches the pour point.

Oil flows through upper duct section 114 where it pools at ocean surface 50. Water also flows with the oil. However, the oil on the surface does not flow into a large area. Instead, the oil and water collect in floating catch basin reservoir 160 (FIG. 1). One or more oil containment booms 162 surround the reservoir to prevent the oil from flowing out of the reservoir. The booms may support the reservoir, or separate floatation device may support the reservoir. The reservoir may be formed of similar material forming the ducts.

Oil in the reservoir floats on the water because of density differences. Thus, oil can be pumped from the top without seawater. The water can be pumped separately back into the ocean. The area and depth of reservoir should be large enough to hold the anticipated amount of oil and water for long enough so that they do not overflow before oil can be pumped from the reservoir to a recovery vessel. However, if a vessel is not available, the conduit can transfer the liquid and gas to a floating bladder or basin for containment until more suitable storage is available.

Oil on the surface in reservoir 160 contains volatile hydrocarbons, which can cause pollution. Therefore, covering the collected oil or collecting it oil below the surface may be desirable. In FIG. 2, oil from duct 110 flows into a containment bladder 170 beneath the level 50 of the ocean. The bladder is formed of plastic or other material and is large enough to store sufficient oil until it can be offloaded.

Containment bladder 170 is supported beneath the surface of the water by a floatation ring 172 or other flotation devices. The floatation ring is shown at the periphery of the bladder, but it could be at other locations above or below the bladder. More than one floatation device could be used. In addition, a ship or other vessel ship also can hold the containment bladder at a desired depth.

Floatation ring 172 or other flotation devices also can support containment bladder 170 at the surface of the water. See FIG. 3, which shows the oil level 180 at the level of the water surface 50.

While receiving recovered oil, the bladder can vent though openings 174 or 176 (FIG. 2) any unwanted or wanted volatile organic gases. The gasses may vent to pollution control apparatus (not shown). The openings may be positioned below the surface of the ocean depending on environmental and other factors. The recovered oil can be removed from the containment bladder at desired intervals.

Though the system is designed primarily for leaking oil wells, it may also be useful for other environments such as oil leaking naturally from underwater fissures or from other fluids leaking from underwater.

When detailed descriptions reference one or more drawing figures, the element being discussed is visible in that drawing. The element also may be visible in other figures. In addition, to avoid crowding of reference numerals, one drawing may not use a particular reference numeral where the same element is in another drawing with the reference numeral.

The description is illustrative and not limiting and is by way of example only. Although this application shows and describes examples, those having ordinary skill in the art will find it apparent that changes, modifications or alterations may be made. Many of the examples involve specific combinations of method acts or system elements, but those acts and those elements may be combined in other ways to accomplish the same objectives. With regard to flowcharts, additional and fewer steps may be taken, and the steps as shown may be combined or further refined to achieve the methods described. Acts, elements and features discussed only in connection with one embodiment are not intended to be excluded from a similar role in other embodiments.

"Plurality" means two or more. A "set" of items may include one or more of such items. The terms "comprising," "including," "carrying," "having," "containing," "involving," and the like in the written description or the claims are open-ended, i.e., each means, "including but not limited to." Only the transitional phrases "consisting of" and "consisting essentially of" are closed or semi-closed transitional phrases with respect to claims. The ordinal terms such as "first," "second," "third," etc., in the claims to modify a claim element do not by themselves connote any priority, precedence, or order of one claim element over another or the temporal order in which acts of a method are performed. Instead, they are used merely as labels to distinguish one claim element having a certain name from another element having a same name (but for use of the ordinal term). Alternatives such as "or" include any combination of the listed items.

The invention claimed is:

1. A system for recovering oil leaking from an under-water oil well comprising:

a flexible duct having a top and bottom, the bottom being positioned adjacent to the well and extending generally upward from adjacent the well toward the top of the duct;

the duct having a sufficient diameter near the bottom to dissipate the pressure of the oil within the duct;

wherein the duct comprises a plurality of duct sections, each duct section having a top and bottom, the top of one duct section attaching to the bottom of the adjacent duct section; and wherein the duct sections have an outer member forming the duct sections, the outer member having an inner and outer surface, the system further comprising an inflatable member on the inner surface of one duct section and an inflatable member on the outer surface of an adjacent duct section, the inflatable members of the adjacent duct section being able to be in contact with each other when the adjacent duct sections are attached to each other.

2. A method for transporting oil from a leaking underwater oil well toward the surface of the water comprising:

positioning a flexible duct having a top and bottom end such that the bottom end surrounds at least most of the oil leaking from the well, wherein the duct comprises a plurality of duct sections, each duct section having a top and bottom, the method further comprising attaching the top of one duct section to the bottom of an adjacent duct section;

supporting the top of the duct toward the surface of the water;

allowing the oil to move toward the top of the duct; and inflating bladders on adjacent duct sections so that the bladder of one duct section contact the bladder of the adjacent duct section.

3. The method for recovering oil of claim 2 wherein the duct comprises a plurality of duct sections, each duct section having a top and bottom, the method further comprising attaching the top of one duct section to the bottom of an adjacent duct section.

4. The method for recovering oil of claim 2 further comprising collecting escaping oil in a hood above the leaking oil, the oil flowing from the hood into the duct.

5. The method for recovering oil of claim 2 further comprising allowing water to flow from at least one opening of the duct.

6. The method for recovering oil of claim 2 further comprising injecting hot fluid into the oil for maintaining the oil at an elevated temperature.

7. A system for recovering oil leaking from an underwater oil well comprising:

a flexible duct having a top and bottom, the bottom being positioned adjacent to the well and extending generally upward from adjacent the well toward the top of the duct; wherein the duct comprises a plurality of duct sections, each duct section having a top and bottom, the top of one duct section attaching to the bottom of the adjacent duct section and wherein the duct sections have an outer member forming the duct sections;

the duct having a sufficient diameter near the bottom to dissipate the pressure of the oil within the duct;

the system further comprising at least one perforation through the outer member for allowing water in the duct to flow through the outer member; and a backing inside the outer member at the perforation, the backing having a top and bottom, the bottom of the backing being against the outer member and the top of the backing being spaced from the outer member.

8. The system for recovering oil of claim 7 further comprising at least one buoyant member attached near the top of the duct.

9. The system for recovering oil of claim 7 wherein the duct comprises a plurality of duct sections, each duct section having a top and bottom, the top of one duct section attaching to the bottom of the adjacent duct section.

10. The system for recovering oil of claim 9 further comprising means on the duct sections for securing the adjacent duct sections together.

11. The system for recovering oil of claim 9 wherein the duct sections have an outer member forming the duct sections, the outer member having an inner and outer surface, the system further comprising an inflatable member on the inner surface of one duct section and an inflatable member on the outer surface of an adjacent duct section, the inflatable members of the adjacent duct section being able to be in contact with each other when the adjacent duct sections are attached to each other.

12. The system for recovering oil of claim 7 wherein the duct sections have an outer member forming the duct sections, the system further comprising a hood attached to the bottom of the duct and extending beyond the outside of the outer member.

13. The system for recovering oil of claim 7 further comprising a canopy on the outside of the outer member at the perforation.

14. The system for recovering oil of claim 7 further comprising a reservoir at the top of the duct for collecting oil flowing out of the top of the duct.

15. The system for recovering oil of claim 14 wherein the reservoir is contained at its top and bottom.

16. The system for recovering oil of claim 15 further comprising second buoyant members attached to the reservoir.

17. The system for recovering oil of claim 7 further comprising at least one tube connected at one end to a source of fluid at an elevated temperature, the other end of the tube being positioned for injecting the fluid into the leaking oil.

* * * * *

UNITED STATES PATENT AND TRADEMARK OFFICE

CERTIFICATE OF CORRECTION

PATENT NO. : 8,517,632 B2
APPLICATION NO. : 13/115774
DATED : August 27, 2013
INVENTOR(S) : Later It is certified that error appears in the above-identified patent and that said Letters Patent is hereby corrected as shown below:

In the Specification

Column 4, line 18: replace "(only cables 134 and are visible in FIG. 1)" with --(only cables 134 and 136 are visible in FIG. 1)--.

Column 6, line 37: replace "other vessel ship" with --other vessel--.

Signed and Sealed this
Tenth Day of December, 2013

Margaret A. Focarino

Margaret A. Focarino
*Commissioner for Patents of the United States Patent and Trademark Office*